United States Patent [19]

Shaw et al.

[11] Patent Number: 4,993,459

[45] Date of Patent: Feb. 19, 1991

[54] SUPPLYING AND GUIDING WEFT THREAD ON WEAVING MACHINES

[75] Inventors: Henry Shaw, Vleteren; Dirk Lewyllie, Wervik; José Vangheluwe, Ieper, all of Belgium

[73] Assignee: Picanol N.V., Belgium

[21] Appl. No.: 416,480

[22] Filed: Oct. 3, 1989

[30] Foreign Application Priority Data

Oct. 3, 1988 [BE] Belgium ..... 8801129

[51] Int. Cl.[5] ..... D03D 47/30

[52] U.S. Cl. ..... 139/452; 139/435.1; 139/453

[58] Field of Search ..... 139/452, 435.1, 453, 139/116.2, 450; 242/47.01

[56] References Cited

U.S. PATENT DOCUMENTS

| | | | |
|---|---|---|---|
| 4,749,006 | 6/1988 | Miyamoto | 139/370.2 X |
| 4,756,341 | 7/1988 | Takehara | 139/452 X |
| 4,832,091 | 5/1989 | Shaw | 139/452 X |

FOREIGN PATENT DOCUMENTS

| | | | |
|---|---|---|---|
| 0269140 | 6/1988 | European Pat. Off. . | |
| 0306079 | 3/1989 | European Pat. Off. | 139/452 |
| 8712946.9 | 1/1988 | Fed. Rep. of Germany . | |
| 63-227832 | 9/1988 | Japan | 139/452 |
| WO89/02944 | 4/1989 | PCT Int'l Appl. . | |

*Primary Examiner*—Andrew M. Falik

*Attorney, Agent, or Firm*—Bacon & Thomas

[57] ABSTRACT

In a weaving machine, one of the guiding elements used to normally guide a weft thread between a thread preparation mechanism and the shed of the weaving machine is made moveable. The moveable guiding element may, for example, be an auxiliary weft insertion nozzle and can be used in place of supplemental threading and guiding mechanisms for such as purposes as retrieving a broken weft thread for automatic rethreading or extracting a defective weft thread from the shed.

22 Claims, 6 Drawing Sheets

1
10
9
3
14
82
11
69
83
70
73
72
76
74
4
39
78
P3
79
5
46
45
50
44
40
6
20
19
7
43
37

1
10
9
3
78
14
82
84
83
4
11
69
39
70
5
79
76
73
74
72
50
46
45
44
40
6
20
19
7
43
37

1
10
9
3
14
D1
78
39
4
11
82
69
76
5
79
70
72
74
46
73
50
45
44
40
6
20
19
7
43
37

1
10
9
3
78
14
82
39
83
4
11
69
5
70
76
79
74
73
72
50
46
45
44
40
6
20
19
7
43
37

1
3
9
10
11
14
69
70
72
73
74
76
78
79
82
83
39
40
5
6
7
19
20
37
43
44
45
46
50
4
D2
P1

1
3
9
10
11
12
14
69
70
72
73
74
76
78
79
82
83
39
40
5
6
7
19
20
37
43
44
45
46
50
4
D2
P1

1
3
9
10
11
12
14
69
70
72
73
74
76
78
79
82
83
39
40
5
6
7
19
20
37
43
44
45
46
50
4

1
3
9
10
11
12
14
69
70
72
73
74
76
78
79
82
83
85
86
90
39
40
5
6
7
19
20
37
43
44
45
46
50
4
P2

SUPPLYING AND GUIDING WEFT THREAD ON WEAVING MACHINES

BACKGROUND OF THE INVENTION

This invention concerns a device and a method for supplying and guiding weft thread on weaving machines, in particular on airjet weaving machines.

In particular, the invention concerns a device which enables a weft thread to be supplied automatically between a thread preparation mechanism, for example a prewinder device, and the insertion means with which successive weft threads are inserted into the shed, for example a main nozzle.

Supplying a weft thread automatically between a prewinder device and a main nozzle for the purpose of enabling automatic thread repair in case of a thread break without weaver intervention, is known. The known devices and methods make use of various supplementary, movable thread clips and other gripping devices, which after the broken thread ends have been removed, can grip a new weft thread near the prewinder and lead it to the main nozzle, whereupon the thread is transferred to the main nozzle. The supplementary thread clips or other similar gripping devices used for this purpose do not carry out any function during the normal weaving process but are kept in a standby condition in the vicinity of the prewinder device. These devices have the disadvantage that they are not very compact, because of the need for a large number of extra components, so that during the normal weaving process they add unnecessary weight and take up an inordinate amount of room in the weaving machine, thus impeding the placing of other automatic devices.

SUMMARY OF THE INVENTION

And object of the present invention is to provide a device and a method for supplying and guiding weft threads on weaving machines which avoids the above disadvantages.

The invention also has as its object the provision of a device by means of which rethreading of a main nozzle mounted on the sley can be carried out automatically, irrespective of the sley position.

Another object of the invention is to automatically supply the correct length of weft thread in the main nozzle when rethreading the main nozzle.

Yet another object of the invention is to position an auxiliary main nozzle according to the type of weft thread, so that the auxiliary main nozzle is kept in its optimum position during weaving, and can if necessary be adjusted during the weaving process.

In order to achieve its objects, the present invention provides a device of the type which enables a weft thread to be supplied automatically form the thread preparation mechanism up to a point from which the weft thread is inserted into the shed, and which includes a movable guide element which guides the weft thread in its path during the normal weaving process and which, in order to supply a weft thread, can be moved between at least a first position near the above-mentioned thread preparation mechanism, and a second position near the point at the entrance to the shed from which the weft threads are inserted into the shed. The device also includes a drive mechanism for moving the guide element and a control device controlling the movement of the guide element. The guide element should preferably include a movable auxiliary main nozzle, which may be equipped with a clip in order to grip the weft thread at suitable moments.

Because the invention uses a thread guide element which is already employed during the normal weaving process, the use of separate, supplementary thread presentation elements and the transport mechanisms required for them is avoided, and there are no complicated cycles of movement. This results in the advantage that when a thread break occurs a repair can be carried out very quickly. This advantage is particularly great when, as described in detail below, the movable thread guide element is formed by the conventional auxiliary main nozzle, which in this case is movably mounted so that it can be moved to and fro between the thread preparation mechanism and the main nozzle.

According to the method of the invention, whenever a weft thread has to be supplied from the thread preparation mechanism to entrance of the shed a movable guide element, starting from the position which it occupies during the normal weaving process, is presented to the thread preparation mechanism where it grips the thread to by its free end, takes it to the insertion device to which the thread is to be supplied, and then moves back to the position which it occupies during the normal weaving process, such that the weft thread remains present in said guide element. Where use is made of a thread preparation mechanism which includes a conventional prewinder, the weft thread is preferably gripped near the exit of the winding tube, whereupon it is led to the entrance of the main nozzle, which is generally mounted on the sley.

BRIEF DESCRIPTION OF THE DRAWINGS

In order to explain better the characteristics of the invention, various preferred embodiments are now described, by way of example only and without being limitative in any way, with reference to the accompanying drawings, wherein.

DESCRIPTION OF THE PREFERRED EMBODIMENTS

Figure 1:
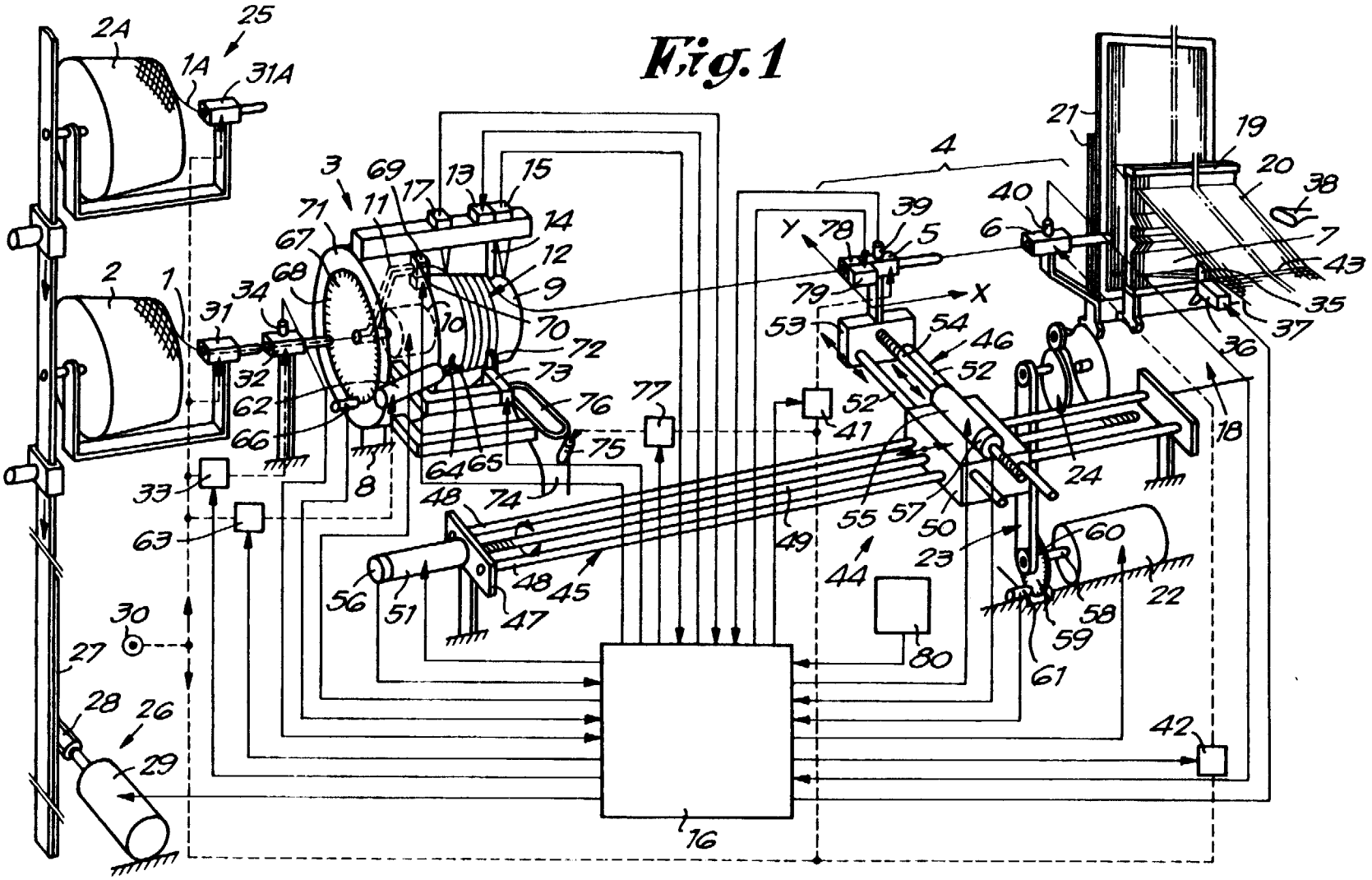
FIG. 1, is a combined perspective view of the mechanical portions and schematic view of the electrical portions according to a preferred embodiment of the invention.

FIG. 1 shows a device for feeding, supplying and guiding a weft thread 1 on a weaving machine. For this purpose, the weft thread 1 is drawn from a yarn package 2 and brought into the shed 7 in the known way via a prewinding device 3 and an insertion means 4. The insertion means 4 in this case is formed by an auxiliary main nozzle 5 and a main nozzle 6. The prewinding device 3, which is mounted in a known way on the frame 8 of the weaving machine, or which is mounted on a mobile frame which can be placed near the weaving machine, includes as is known a fixed prewinder drum 9, a winding tube 11 which is driven by an electric motor 10 and which lays the weft thread 1 in turns 12 on the prewinder drum 9, and a retaining pin 14 which is actuated by a solenoid 13. The retaining pin 14 in its rest position operates on the surface of the prewinder drum 9 and prevents the weft thread 1 from being drawn from the prewinder drum 9. Also, whenever the solenoid 13 is energized, the retaining pin 14 takes up a raised position in which the weft thread 1 can be drawn from the prewinder drum 9 as a result of the force exerted by the auxiliary main nozzle 5 and the main nozzle 6. The number of turns 12 drawn from the prewinder drum 9 is monitored by means of a draw-off detector 15, preferably of an optical type, formed by a light source and a receiver, such that each time a turn is drawn off a signal is supplied to the general control unit 16. A turn detector 17, also connected to the control unit 16 and also of the optical type, enables the presence of turns 12 on the prewinder drum 9 to be monitored. If the detector 17 does not detect turns any more, it generates a signal such that the control unit 16 actuates the motor 10, or causes it to operate at a faster speed, so that a reserve of turns is laid on the prewinder drum 9 once more. If turns are detected once more at the point of the detector 17, the motor 10 is stopped until more new turns are required again.

A number of other known parts are also indicated in FIG. 1, such as the sley 18 with the reed 19, the warp threads 20, and the harnesses 21. Also indicated is the main drive 22 of the weaving machine, which amongst other things drives the sley 18 via a transmission mechanism 23, the transmission mechanism 23 including a cam drive 24, and a movable package frame 25 which, in case of a fault in the weft thread 1, for example a break between said yarn package 2 and the main nozzle 6, makes it possible to switch over to a second yarn package 2A in the manner described below. Other parts indicated in FIG. 1 include a drive mechanism 26 for moving the package frame 25, for example consisting of a rack 27 which can be moved by means of a motor 29 acting through a pinion 28; a compressed air source or connection 30 for operating the various components discussed below; and nozzles 31 and 31A connected to the compressed air source 30, which operate continuously and which hold the free ends of the weft threads 1-1A whenever they are not in use. If required, a nozzle 32 fixedly-mounted on the frame 8 of the weaving machine and in line with the entrance to the winding tube 11 may also be included. By means of nozzle 32 a weft thread 1 can be supplied from a second nozzle 31 presented in front of entrance of the first nozzle 32 to the winding tube 11, the first nozzle 32 being actuated, for example by an electromagnetic valve 33 operated by the control unit 16. Finally, FIG. 1 also shows a thread detector 34, for example an optical type, connected to the control unit 16 and operating in conjunction with the said first nozzle 32, for detecting the presence of weft thread in nozzle 32; a cutter 35 with its drive 36, mounted in the known way close to the cloth edge 37; and a suction nozzle 38 located at the receiving side of the shed 7 and in line with it.

The main nozzle 6 is preferably mounted on the sley 18. Both nozzles, namely the auxiliary main nozzle 5 and the main nozzle 6 respectively, are equipped with a thread detector, 39 and 40 respectively, said thread detectors also being connected to the control unit 16. Both nozzles 5 and 6 are actuated in the known way by the control unit 16, by means of electromagnetically operated compressed air valves 41 and 42.

During the normal weaving process, at each weaving cycle a length of weft thread is brought into the shed 7 by means of the above-mentioned insertion means 4. In so doing the weft thread 1 is drawn from the thread preparation mechanism, in this case the prewinding device 3 and in particular from the prewinder drum 9. In order to achieve this, at each weaving cycle the retaining pin 14 is removed from the surface of the prewinder drum 9 by energizing the solenoid 13, until the necessary number of turns 12 required to form a length of weft thread are drawn from the prewinder drum. As soon as one length of weft thread has been released and inserted into the shed 7, the retaining pin 14 is returned to the position in which it makes contact with the prewinder drum 9, such that it prevents more turns 12 from being drawn off than is necessary.

Subsequently, as is known, the sley 18 with the reed 19 mounted on it is moved up to the fell line 43 by means of the drive 22 controlled by the control unit 16, such that the length of weft thread 1 inserted is beaten up against the cloth fell. The weft thread 1 is then cut free by the weft cutter 35, whereupon the nozzles 5 and 6 are deactivated, or are operated at a lower air pressure purely in order to hold taut the free end of weft thread present in the nozzles. The sley 18 is then moved back from the fell line 43, whereupon a new weaving cycle can begin.

During the normal weaving cycle, the weft thread is monitored for thread breaks and the like. In order to carry out monitoring between the prewinding device 3 and the entrance to the shed 7, use is made of, for example, the above-mentioned thread detectors 39 and 40. If one of these thread detectors ceases to detect a weft thread 1, this indicates a thread break. The present invention concerns a special device which in such a case enables a new weft thread 1 to be supplied automatically from the prewinding device 3 to the entrance of the shed 7.

For this purpose, the device of the present invention makes use of a guide element which during the normal weaving process guides the weft thread 1 in the correct path between the prewinding device 3 and the entrance to the shed 7, where in order to carry out rethreading if a thread break occurs, the guide element can be moved between a first position next to the thread preparation mechanism—e.g. the prewinding device 3 shown in FIG. 1—and a second position next to the entrance to the shed 7, in particular next to the main nozzle 6.

In the preferred embodiment, as shown in FIG. 1, the guide element includes the auxiliary main nozzle 5, which for this purpose is movably mounted. The movement is obtained by means of a drive mechanism 44 actuated by the control unit 16, which for this purpose is of course provided with the necessary electronic circuits, whose design can be simply deduced from the following description of the working process which must be carried out in the case of a break.

As shown in FIG. 1, the drive mechanism 44 includes two translation mechanisms 45 and 46, which respectively can effect an X and a Y translation of the auxiliary main nozzle 5. The mechanism used for this purpose can be of any desired type. In the embodiment shown in the FIG. 1, the translation mechanism 45 includes a frame 47 holding a number of guides 48 extending in the X direction, along which a slide 50 can be moved by a rotating lead screw 49, the rotation of said lead screw 49 being obtained by means of an electric motor 51, for example a stepper motor controlled by the general control unit 16.

The translation mechanism 46 is formed by a carriage 53 which is movable by means of guides 52 in slide 50, the movement being obtained by means of a lead screw 54 which can be moved in the Y direction by a motor 55 which is similarly controlled by the control unit 16.

The auxiliary main nozzle 5 is mounted at the free end of the carriage 53.

The drive mechanisms are equipped with the necessary detectors, in order to monitor the movement of the auxiliary main nozzle 5. In the embodiment shown in FIG. 1, the motors 51 and 55 are equipped with detectors 56 and 57 respectively, for example in the form of pulse generators which monitor the rotation of the lead screws 49 and 54, sending a pulse every revolution to the control unit 16. From the sense of rotation of the motors 51 and 55 and the number of pulses supplied by the detectors 56 and 57, the position of the auxiliary main nozzle 5 in relation to a reference point can be determined at any moment.

The position in which the slide 50 and the auxiliary main nozzle 5 are closest to the motor 51 and the motor 55 respectively can be taken as the reference point.

According to the present invention, signals which provide information about the exact angular position of the sley 18 are preferably also supplied to the control unit 16. For this purpose the drive 22 of the weaving machine, more particularly the drive shaft 58, is fitted with a disk 59 with markings 60 which are detected by a detector 61 fixedly-mounted next to said disk, which thus generates pulses as a function of the angular rotation of drive shaft 58. Clearly, by this means the position of the sley 18 can be determined at any moment with respect to a reference point. It is of course also possible to use means of detection which operate directly with the sley 18 for this purpose.

Also according to the invention, the prewinding device 3 is equipped with a thread removal mechanism in order to push off the turns 12 present on the prewinder drum 9 whenever required. As shown in FIG. 1, this thread removal mechanism includes a piston 62 mounted on the frame 8 of the weaving machine. Piston 62 can be actuated by means of a pneumatic valve 63 controlled electromagnetically by the control unit 16. The thread removal mechanism also includes a fork 65 mounted on the piston rod 64. Fork 65 can remove all the turns 12 present on the prewinder drum 9 in a single motion.

Further, according to the invention use is made of a detector 66 for detecting the position of the winding tube 11. Detector 66 operates for the example, in conjunction with a disk 67 which rotates with the winding tube 11, bearing a number of markings 68 which are detected by the detector 66. In this way, the angular position of the winding tube 11 with respect to a reference position or reference marks on the disk can be determined unambiguously at any moment by the number of pulses sent by the detector 66 to the control unit 16.

In order to be able to hold the weft thread 1 in the winding tube 11 at suitable moments, use is made of a thread clip 69 which for example is mounted on the end of the winding tube 11 and which is actuated by a solenoid 70 operated by the control unit 16.

A weft cutter 72 mounted on the housing 71 of the prewinding device 3 enables the weft thread 1 to be cut at the exit of the winding tube 11. The cutter is activated by means of a stepper motor 73 which in turn is controlled by the control unit 16.

A thread removal mechanism such as a fixedly-mounted suction nozzle 74 mounted next to or underneath the prewinder drum 9 enables the thread waste rejected from the prewinder drum 9 to be collected and evacuated. The suction action is obtained by means of a blower nozzle 75 mounted in the suction nozzle 74 such that it generates an airstream oriented away from the intake 76. The blower nozzle 75 is controlled by the control unit 16 by means of an electromagnetically operated pneumatic valve 77.

Finally, according to the invention use is also made of a thread clip 78 mounted at the intake of the auxiliary main nozzle 5 and which can be actuated and deactuated by means of a solenoid 79 controlled by the control unit 16.

In summary, the control unit 16 controls all the moving and actuated parts in FIG. 1, while the necessary information for this purpose is drawn from the data provided by all of the detection elements described in connection with control unit 16.

The control unit 16 can also be equipped with an input unit 80 in order to supply the data necessary for controlling all the parts, in particular with relation to the positions which the auxiliary main nozzle 5 must take, as described below, in order to carry out an automatic rethreading, including the above-mentioned first position beside the winding tube 11, the second position beside the main nozzle 6, and also the position which it assumes during the normal weaving process.

The device for feeding, supplying and guiding weft threads, in particular in which use is made of the above-mentioned movable auxiliary main nozzle 5, offers various advantageous potential uses. A first possibility is a method for automatically supplying a weft thread 1 between the prewinding device 3 and the main nozzle 6, as described below with reference to FIGS. 2 to 13, in which for the sake of clarity only the most essential components are shown schematically.

Figures 2, 3, 4:
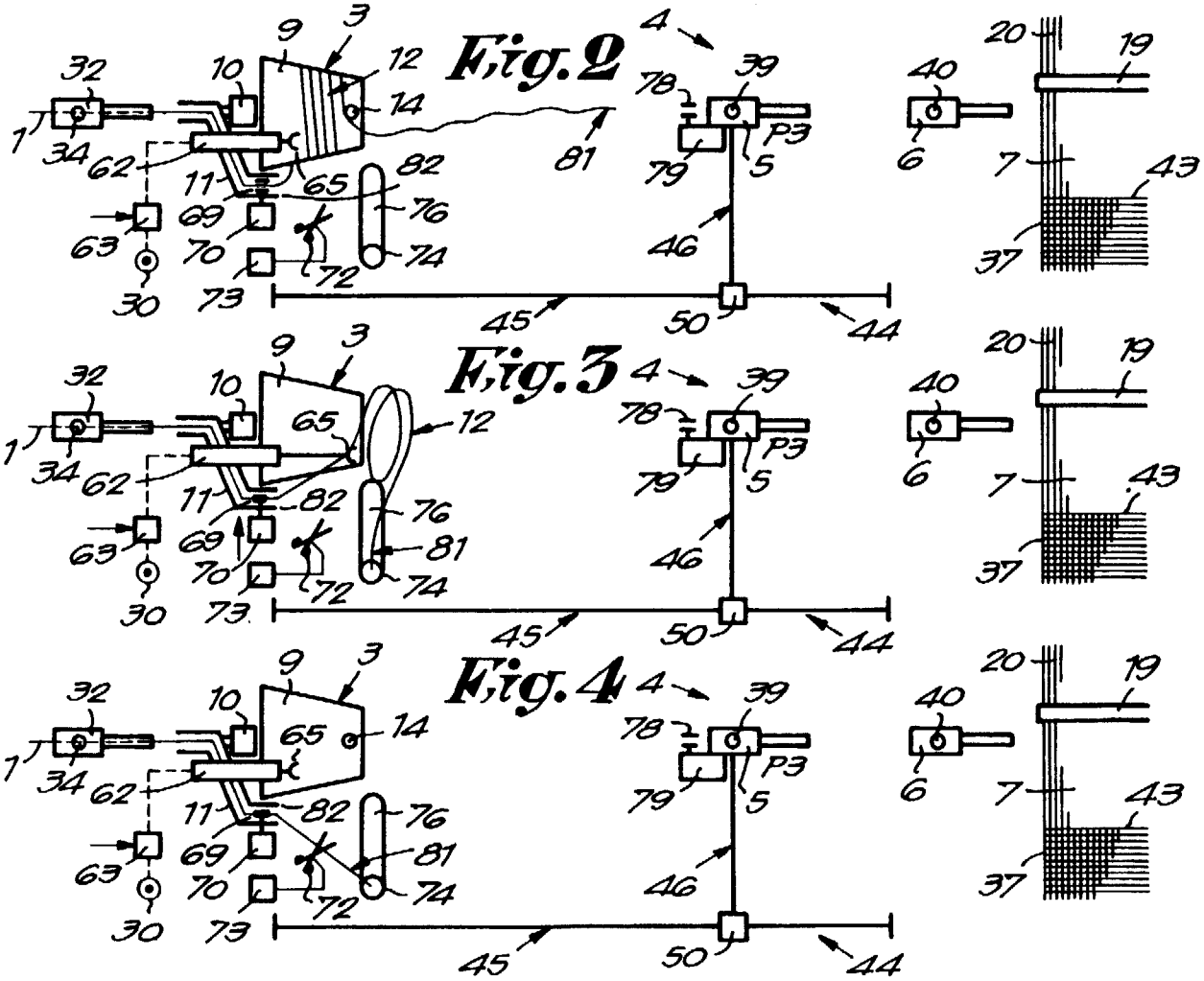
FIGS. 2 to 13 illustrate schematically the successive steps of a preferred method according to the invention, in each case as a top schematic view of FIG. 1.

In FIG. 2 a thread break has occurred between the prewinding device 3 and the auxiliary main nozzle 5. The weft thread 1 has a free end 81 located outside the auxiliary main nozzle 5. The fact that a break has occurred between the prewinding device 3 and the main nozzle 6 can be deduced from the signals from the thread detectors 34, 39 and 40. In such a case the detectors 39 and 40 do not detect a thread any more, while the detector 34 does detect a thread.

As a consequence of this fault the control unit 16 actuates the motor 10 of the prewinding device 3, such that the winding tube 11 is brought into a particular position, with its exit 82 near to the above-mentioned weft cutter 72. In order to achieve this, the motor 10 is actuated until the detector 66 detects a signal which corresponds with the corresponding marking 68 on the disk 67.

In the following step, as shown in FIG. 3, the thread clip 69 is closed by energizing the solenoid 70 and the number of turns 12 still remaining on the prewinder drum 9 is ejected by actuating the piston 62, which causes fork 65 to slide in the direction of the suction nozzle 74 so that the turns are pushed off the prewinding drum and are sucked up by said suction nozzle 74. As a result, the length of weft thread held taut between the exit 82 of the winding tube 11 and the suction nozzle 74 comes within the cutting range of the above-mentioned cutter 72.

Figure 5:
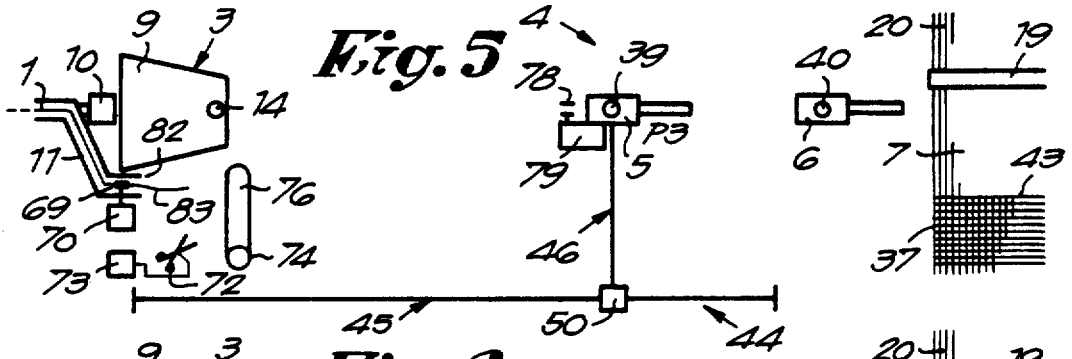

The quantity of weft thread 1 rejected is then cut off by actuating the cutter 72, as shown in FIG. 4. As a result, as shown in FIG. 5, a free thread end 83 is formed at the exit of the prewinding device 3, or in this case at the exit of the winding tube 11, such that thread end 83 has a certain length, in particular equal to the distance between the thread clip 69 and the cutter 72. The closed thread clip 69 prevents the thread end 83 from jumping back into the winding tube 11 when it is cut.

Figure 6:
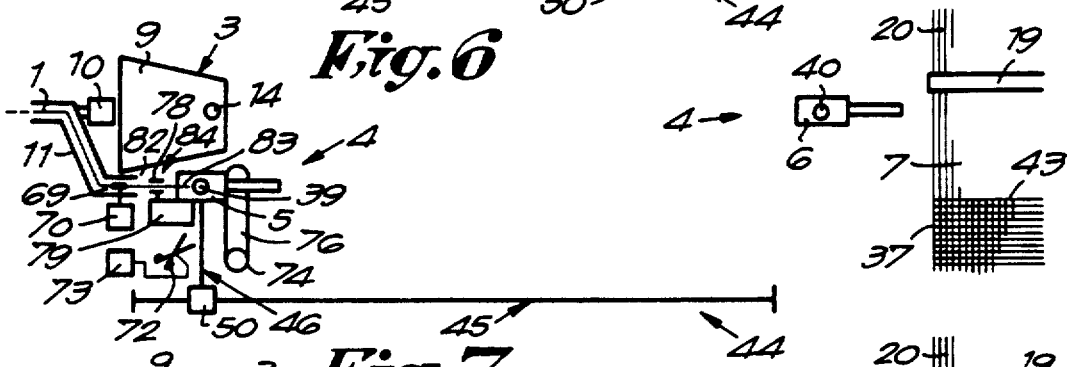

In the next step, the drive mechanisms are actuated by the control unit 16 such that the movable auxiliary main nozzle 5 is presented with its entrance 84 at the exit of the winding tube 11. The above-mentioned thread clip 78 is then in its open position. The auxiliary main nozzle 5 is actuated by energizing the valve 41 and sucks up the thread end 83. Here it should be noted that the thread end 83 is kept relatively short in order to make it easier to suck up, and that as a result, as shown in FIG. 6, it will only be partly present in the auxiliary main nozzle 5.

Figure 7:
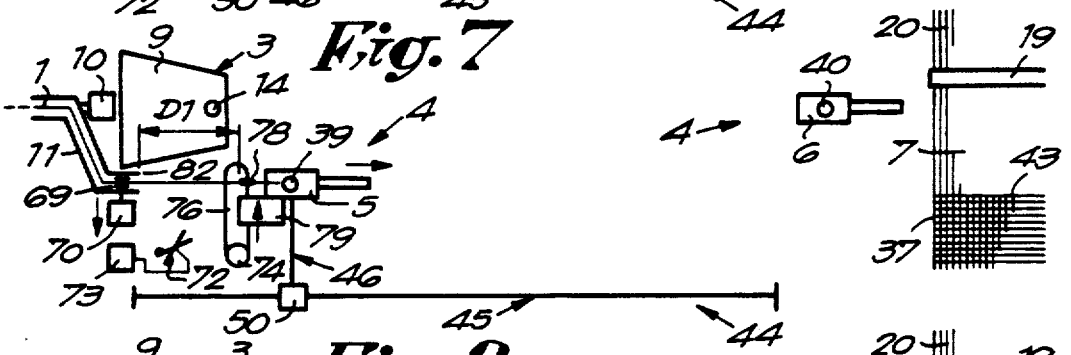
Figure 8:
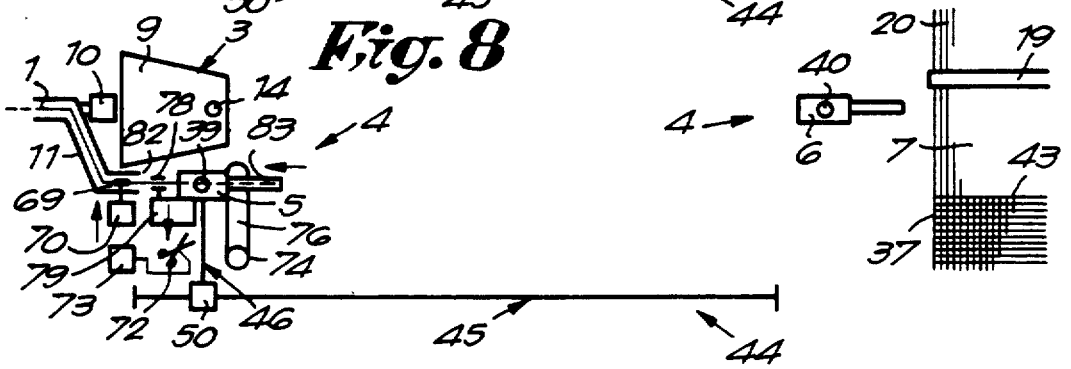

Next, the thread clip 78 is closed and the thread clip 69 opened, whereupon, as shown in FIG. 7, the auxiliary main nozzle 5 is withdrawn over a short distance D1 from the exit 82 of the winding tube 11, with the result that the weft thread 1 is drawn with it. The thread clip 69 is then closed once more in a similar way and the thread clip 78 opened, whereupon as shown in FIG. 8 the auxiliary main nozzle 5 is moved back up to the exit of the winding tube 11, such that the thread end 83 is sucked up further, with the result that thread end 83 is stretched over approximately the whole length of the auxiliary main nozzle 5.

Figure 9:
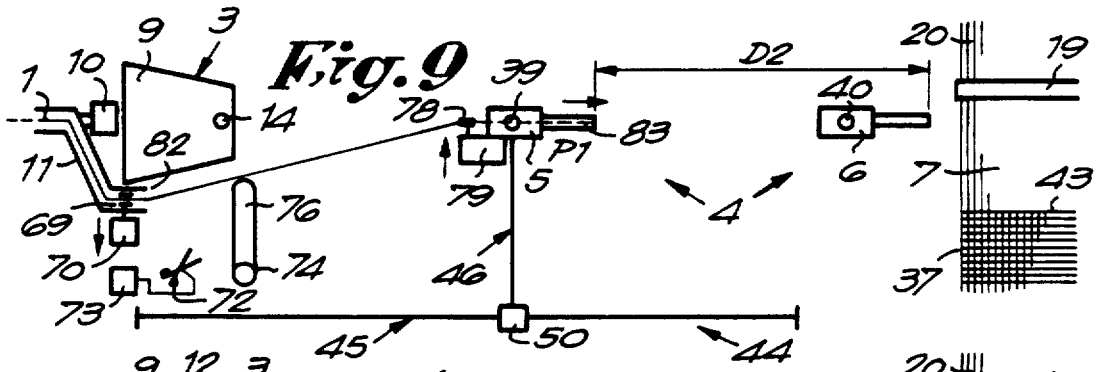

The thread clip 78 is then closed again and the thread clip 69 opened, whereupon the auxiliary main nozzle 5 is moved by means of the drive mechanism 44 to a position P1 at a certain distance from the prewinding device 3, for example centrally in front of it, as shown in FIG. 9. The position P1 is chosen such that the leading end of the weft thread 1 is located at a position in which the distance D2, between the end of the weft thread 1 and the point at which this end should be located after rethreading is equal to the distance which can be measured off precisely on the prewinder drum 9, or which can be left free. The distance D2 is preferably equal to the length of weft thread equivalent to one turn 12.

Figure 10:
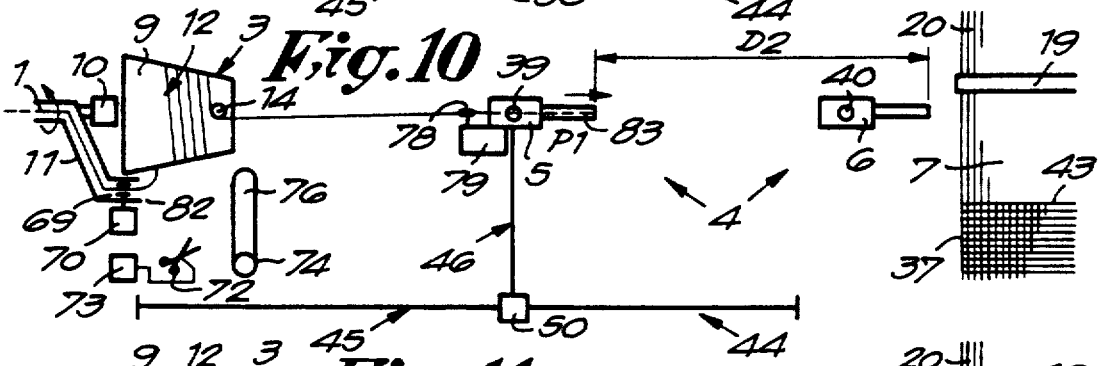

In the next step, the motor 10 of the winding tube 11 is actuated, and a number of turns 12 are laid on the prewinder drum 9 until the detector 17 detects turns, such that a condition is reached as shown in FIG. 10. During the winding, the auxiliary main nozzle 5 remains in the position P1.

Figure 11:
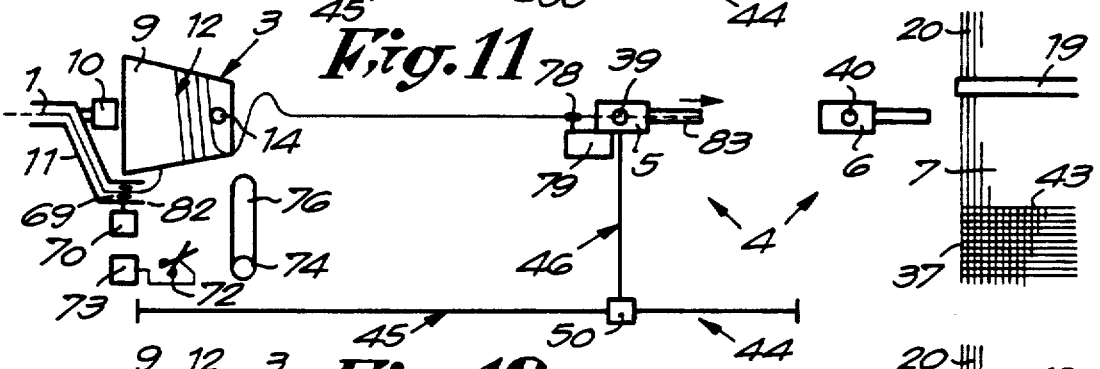

Next, as shown in FIG. 11, a length of weft thread 1 corresponding to the distance D2 is released by opening the retaining pin 14, moving the auxiliary main nozzle 5 and with the help of the draw off detector 15 detecting the drawing off of one turn 12, whereupon the retaining pin 14 is closed once more, with the result that precisely one turn is released.

Figure 12:
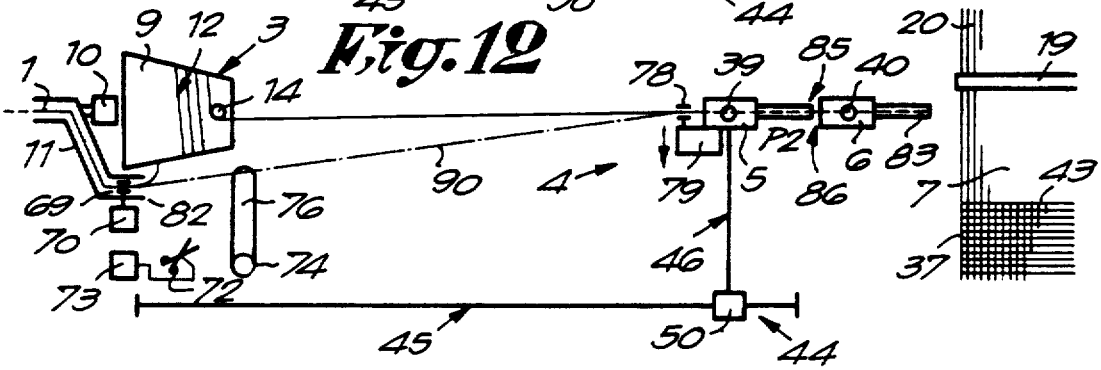

The auxiliary main nozzle 5 is then moved to a position P2 as shown in FIG. 12, such that the exit 85 of the auxiliary main nozzle 5 is presented at the entrance 86 of the main nozzle 6, whereupon the thread clip 78 is opened. Here it should be noted that the main nozzle 6 is positioned at a particular point by actuating the drive 22 with the help of the above-mentioned means, in particular the detector 61 and the control unit 16, until the sley 18 reaches the correct position. By choosing the correct position P1 as described above, a condition is reached in which the thread end 83 of the weft thread 1 reaches precisely up to the main nozzle 6, i.e. in which the weft thread 1 has the correct length.

The leading end 83 of the weft thread is then in the position in which during the normal weaving process the end of the weft thread 1 is located when it is cut off by the weft cutter 35.

Figure 13:
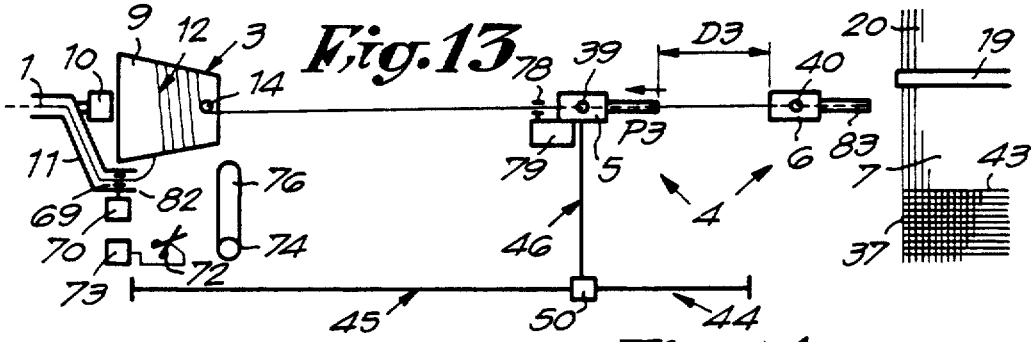

Finally, in order to restart the weaving process, the auxiliary main nozzle 5 is moved back to its normal position P3 at a particular distance D3 from the main nozzle 6, as shown in FIG. 13.

In addition to the method just described, a movable auxiliary main nozzle 5, possibly equipped with the above-mentioned thread clip 78, offers various other possible applications.

Figure 14:
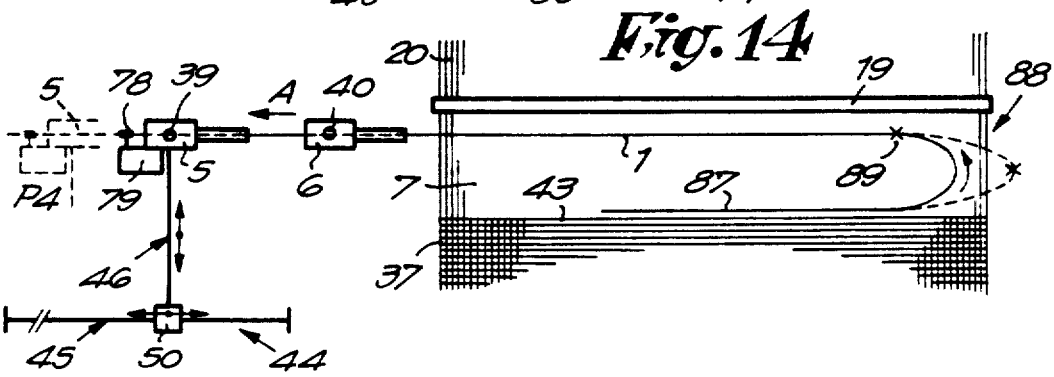
FIG. 14 is a schematic diagram showing a particular application of the device of FIG. 1.

In FIG. 14, the movable auxiliary main nozzle 5 is used in order to remove a faulty section of weft thread 87 from the shed 7. As is known, such a faulty section of weft thread 87 can be connected at the receiving side 88 of the shed 7 to a weft thread 1 which functions as an extraction thread, for example by means of a knot 89. By drawing back the weft thread 1 according to the arrow A, the section of weft thread 87 is drawn away from the fell line 43 in the form of a loop. For this purpose, the auxiliary main nozzle 5 may have a backblow function, such that a tension force is exerted on the weft thread 1 in the opposite direction. However, it may occur that the tension force obtained pneumatically is insufficient to free the section of weft thread 87 initially, since a much greater tension force is required for the initial freeing of the faulty section.

In order to obtain a greater initial force, according to the present invention the movable auxiliary main nozzle 5 can be moved, with the thread clip 78 closed, from its normal position P3 over a small distance to a position P4. As a result, the section of weft thread 87 is pulled free. Further extraction of said section 87 can then continue in the normal way, for example by actuating the auxiliary main nozzle 5 as a backblow nozzle.

The device according to the invention also makes possible a method in which the position of the auxiliary main nozzle 5 is previously set by means of the input unit 80 and the control unit 16, such that the distance D3 is set to an optimum value according to particular weaving parameters or yarn parameters, such as the revolution speed of the machine, the type of thread used, etc.

Here it should be noted that the method as described with reference to FIGS. 3 to 13 can be applied whenever the thread break occurs before the prewinding device 3. Such a thread break can for example be detected by means of the thread detector 34. In this case it is necessary to know with certainty whether the winding tube 11 is completely free. In order to achieve this the winding tube 11 is operated for a few turns more, such that any weft thread 1 remaining in it is wound onto the prewinder drum 9. The quantity of weft thread present on the prewinder drum is then removed as described above and shown in FIGS. 2 and 3. The section of weft thread which possibly extends up to the nozzles 5 and 6 is also removed via the suction nozzle 74. Once the device is completely free of thread, the motor 29 is actuated and the package frame 25 is moved, such that a new weft thread 1A is presented to the blower nozzle 32 and blown into the winding tube 11. By correctly positioning the winding tube 11, the weft thread 1A blown in is taken up into the suction nozzle 74, whereupon the blower nozzle 32 is deactivated. At that moment there is a condition as shown in FIG. 4, whereupon the method can be continued as described above.

According to a variant of the invention, the auxiliary main nozzle 5 can also be brought directly from the position shown in FIG. 8 to position P2 (FIG. 12), without the intermediate halt in position P1 and without the intermediate formation of a number of turns 12. In this case, the weft thread 1 is stretched out along the dot-dash line 90 in FIG. 12. The thread clip 69 is then closed and the thread clip 78 opened and the auxiliary main nozzle 5 is moved back over a certain distance, preferably the above-mentioned distance D1, such that the weft thread 1 comes out of the front exit 85 of the auxiliary main nozzle 5, with a length suitable for threading the main nozzle 6. In order to then be able to thread the main nozzle 6, the thread clip 78 is closed, the thread clip 69 is opened and the auxiliary main nozzle 5 moved towards the main nozzle 6, during which the main nozzle 6 is operated at full power. As a result, the main nozzle 6 sucks up the end of the weft thread 1. The thread clip 69 is then closed again, the thread clip 78 is opened and the auxiliary main nozzle 5 is returned to its normal position P3. By then closing the thread clip 78 once more and opening thread clip 69, a situation is obtained in which turns 12 can be laid on the prewinder drum 9 by actuating the winding tube 11. The weaving process can then be started.

If too long a free section of weft thread hangs out of the main nozzle 6, it can be removed in the known way with the help of the weft cutter 35 and the suction nozzle 38 mounted at the end of the shed 7.

Figure 15:
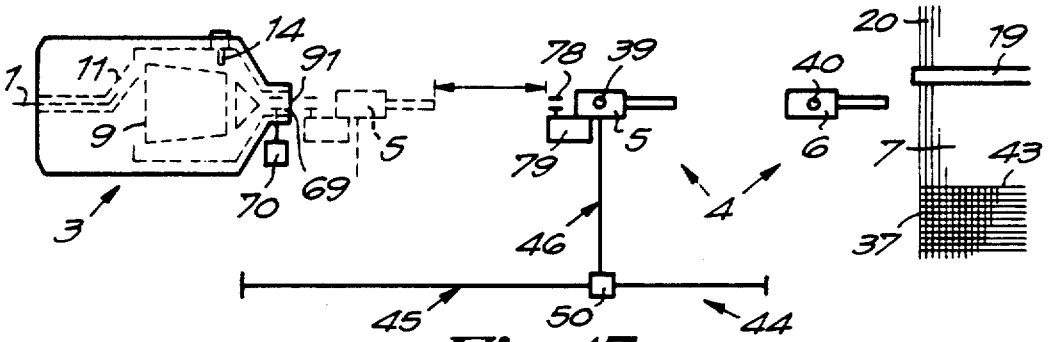
FIGS. 15 and 16 are schematic diagrams of two particular variants of the invention.

Although according to the method described above, the movement of the auxiliary main nozzle 5 continues up to the exit 82 of the winding tube 11, it is clear that where use is made of a prewinding device 3 which can be rethreaded automatically, as shown schematically in FIG. 15 and described in German published application number DE 8712946.9, the auxiliary main nozzle 5 has to be presented not to the exit of the winding tube 11 but to exit 91 at the end of the prewinder drum. Also in this case, the winding tube 11 does not have to be positioned at a particular place. The above-mentioned thread clip 69 is of course positioned at the exit 91 of the prewinding device 3.

Figure 16:
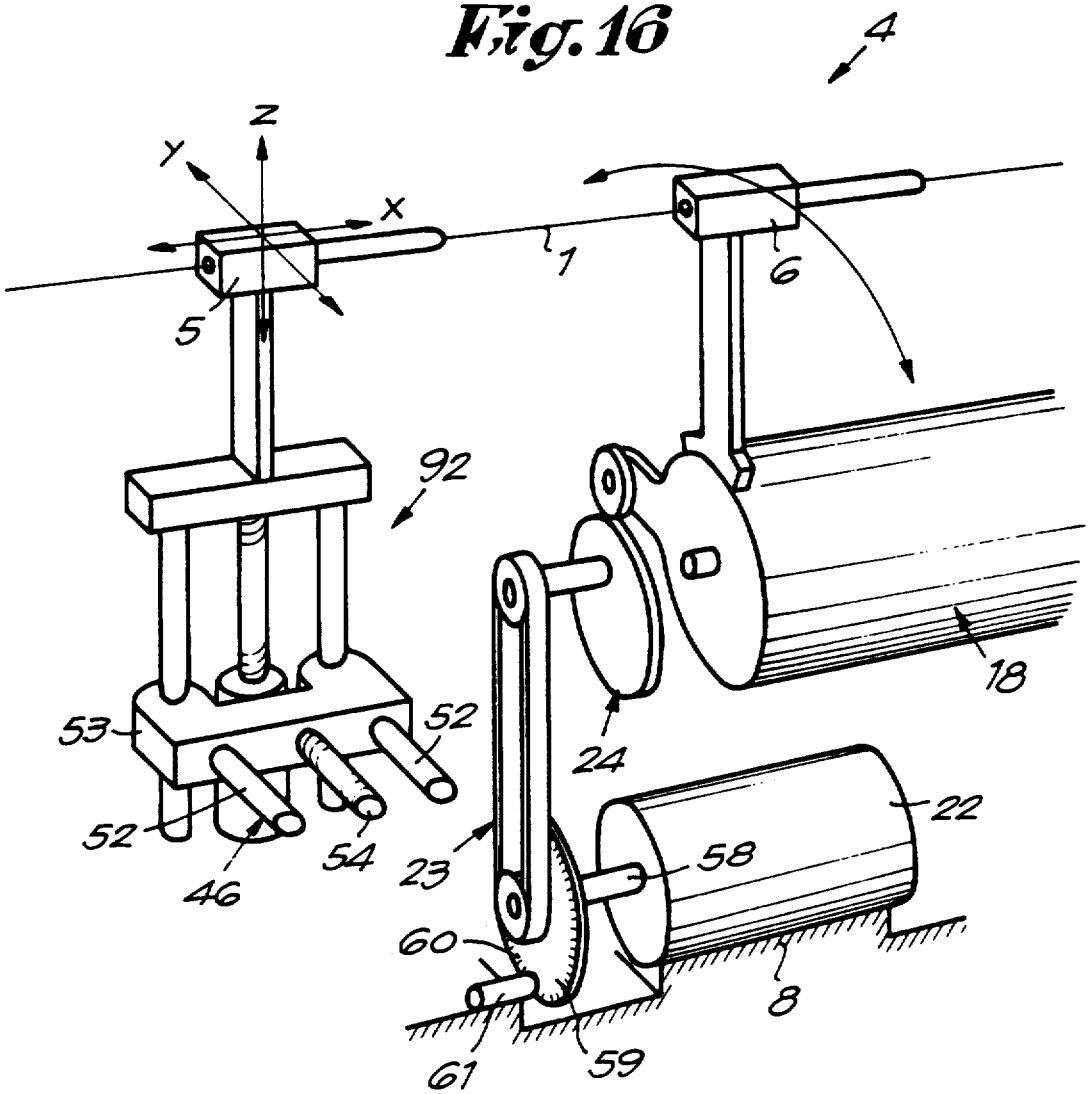

It is also clear that use can be made of a drive mechanism 44 which permits a three-dimensional X-Y-Z movement, as shown schematically in FIG. 16. In this way, the advantage is obtained that the auxiliary main nozzle 5 can always be positioned in front of the main nozzle 6, irrespective of the position of the sley 18. It is always the case that the height Z of the main nozzle 6 varies as a function of the sley position, as a result of its rotational motion. The sley position can be determined by means of the detector 61 already described for this purpose, and from this the height Z of the main nozzle 6 and the position to be taken up by the auxiliary main nozzle 5 can be calculated by the control unit 16. As shown in FIG. 16 a displacement mechanism 92 similar to the translation mechanism 46 can be mounted on the carriage 53, in order to enable the auxiliary main nozzle 5 to move in the Z direction.

Although in the embodiments shown in the drawings the movable guide element for the weft thread is in all cases formed by the auxiliary main nozzle 5, this does not mean that other guide elements cannot be used.

The guide element which guides the weft thread 1 in its path during the normal weaving process and which during rethreading can transport the weft thread from the prewinding device 3 to the beginning of the shed can for example also consist of a thread eye provided with a thread clip.

When working with a main nozzle only, without an auxiliary main nozzle 6, the movable guide element can also consist of the main nozzle, in which case the main nozzle must be movable.

The present invention is not limited to the embodiments described by way of example and shown in the figures; on the contrary, such a device and method for supplying and guiding weft threads can be made in different variants while still remaining within the scope of the invention.

We claim:

1. A device for automatically supplying and guiding weft thread from a thread preparation mechanism to near a point from which a weft thread is inserted into a shed of a weaving machine, comprising means including a movable guide element for guiding a weft thread along a path from the thread preparation mechanism to near the point from which the weft thread is inserted into the shed during the normal weaving process and for supplying a new weft thread for insertion into the shed when said guide element is moved between at least a first position adjacent said thread preparation mechanism and a second position near to the point at an entrance to the shed from which the weft threads are inserted into the shed; means for moving said guide element between said first position and said second position; and control means for controlling said moving means.

2. A device as claimed in claim 1, wherein said moveable guide element includes an auxiliary main weft thread insertion nozzle.

3. A device as claimed in claim 1, wherein the movable guide element includes a thread clip and further including means for moving the thread clip together with the movable guide element.

4. A device as claimed in claim 1, wherein said moving means includes means for enabling the movable guide element to be moved in at least two directions.

5. A device as claimed in claimed in claim 4, wherein said means for enabling said guide element to move in two directions includes two translation mechanisms which operate in mutually perpendicular directions.

6. A device as claimed in claim 5, wherein the two translation mechanisms include slides driven by electric motors and lead screws.

7. A device as claimed in claim 1, wherein the moving means of the movable guide element includes translation means for permitting three-dimensional displacement of the movable guide element.

8. A device as claimed in claim 1, wherein the moving means including detection means connected to the control means for monitoring the movement of the guide element in relation to a reference position.

9. A device as claimed in claim 8, wherein the detection means comprises detectors including pulse generating means for generating pulses in response to movement of the drive means.

10. A device as claimed in claim 1, wherein the thread preparation mechanism includes a first thread clip, the movable guide element includes at an entrance thereto a second thread clip, and said control means includes transfer means for transfering the weft thread from an exit of the thread preparation mechanism to the guide element when said entrance is next to the exit, said transfer means including respective means for: formation at said exit of a thread end which is taken up in the movable guide element as a result of said guide element being presented at said exit, closing the first thread clip, opening the second thread clip, moving the guide element to a small distance from said exit that the weft thread is drawn along over this distance, closing the second thread clip, opening the first thread clip, moving the guide element back to the exit such that the thread end is taken up further in the guide element, once more closing the first thread clip, and once more opening the second thread clip.

11. A device as claimed in 10, wherein the thread preparation mechanism includes a prewinding device having a fixed prewinder drum and a rotating winding tube, and wherein the thread preparation mechanism includes means connected to at least a motor of the winding tube and to said drive means of the movable guide element for stopping the winding tube and presenting the guide element at the exit of the winding tube whenever a weft thread has to be supplied from the thread preparation mechanism to the entrance of the shed.

12. A device as claimed in claim 11, wherein the prewinding device includes cutting means for cutting the weft thread at the point where the weft thread leaves the winding tube, and thread removal means for removing turns of weft thread present on the prewinder drum.

13. A device as claimed in claim 10, wherein the thread prpearation mechanism comprises a prewinding device and means for automatically rethreading the prewinding device such that a weft thread supplied to the prewinding device is automatically led through the prewinding device by the automatic rethreading means and presented at the exit of the prewinding device, and wherein the prewinding device includes means connected to said moving means for controlling movement of the guide element such that if rethreading has to be carried out the guide element is presented at the exit of the prewinding device.

14. A device as claimed in claim 10, wherein the thread preparation mechanism includes a prewinding device having respective means, including a control unit, for successively ensuring during movement of the guide element from its position next to the prewinding device to a position near the shed the following: interruption of the movement of the guide element at a position where the distance between the leading end of the thread which is carried with the guide element and the point to which the leading end is to be brought corresponds to a particular length which can be measured off and released from the prewinding device; actuation of the prewinding device such that a number of turns are formed thereon; and subsequent movement of the moveable guide element so that during this subsequent movement a quantity of weft thread corresponding to said distance between the leading end of the weft thread and the point to which leading end is to be brought is released from the prewinder drum.

15. A device as claimed in claim 10, wherein the device comprises means, including a control unit, for enabling the weft thread to be transferred to a weft thread insertion main nozzle when the guide element is moved into a position adjacent the shed by successively moving the guide element up against the main nozzle, releasing the weft thread into the main nozzle, and returning the guide element to the position which it occupies during the normal weaving process.

16. A method for automatically supplying and guiding a weft thread to a shed on a weaving machine between a thread preparation mechanism and an entrance to the shed, comprising the steps of (a) during the normal weaving process, guiding the weft thread by means of a guide element, (b) when a thread break occurs between the thread preparation mechanism and the shed, moving said guide element such that it is presented at an exit of the weft thread preparation mechanism, and (c) taking up a thread end which is located at said exit into the guide element through an entrance of the guide element and then moving the guide element such that the weft thread taken up therein is brought up to the shed.

17. A method as claimed in claim 16, wherein the weft thread is inserted into the shed by means of an auxiliary main nozzle and a main nozzle, and wherein said moveable guide element comprises at least the auxiliary main nozzle.

18. A method as claimed in claim 16, wherein said thread preparation mechanism includes a prewinding device having a prewinder drum and a winding tube, and further comprising the steps of removing any quantity of thread which may be present on the prewinder drum after a thread break, and then presenting the entrance of the guide element at an exit of the winding arm in order to grip the weft thread.

19. A method as claimed in claim 16, wherein the thread preparation mechanism is automatically rethreadable, and includes a prewinding device having an exit in which a weft thread once inserted is automatically presented at the exit, said method further comprising the step of presenting the entrance of said guide element at said exit of the prewinding device in order to grip the weft thread.

20. A method as claimed in claim 17, wherein the step of taking up said thread end in the auxiliary main nozzle comprises the steps of successively actuating the auxiliary main nozzle and presenting an entrance of the auxiliary main nozzle at the exit of the thread preparation mechanism, gripping said thread end at said exit of the thread preparation mechanism by means of a first thread clip, gripping the thread end by means of a second thread clip located at the entrance to the movable auxiliary main nozzle and which moves with it, opening the first thread clip which holds said thread end fast at said exit; moving the auxiliary main nozzle a small distance relative to said exit; closing the first thread clip once more; actuating the auxiliary main nozzle, opening the second thread clip, returning the auxiliary nozzle to near said exit, closing the second thread clip, and opening the first thread clip.

21. A method as claimed in claim 16, wherein said weaving machine includes a thread preparation mechanism comprising a prewinding device having a prewinder drum and winding tube, said method further comprising the steps of stopping the movable guide element at an intermediate position during its movement, such that the thread end of the weft thread taken up in the guide element is located at a point where the distance to the point in which the thread end should be located at the begining of an insertion of the thread into the shed is equal to a length which can be measured by means of the prewinder drum; laying, whenever the movable guide element is located in said intermediate position, a number of turns on the prewinder drum by means of the winding tube; releasing the quantity of thread required by actuating a retaining pin and bringing the movable guide element into its position near to the shed.

22. A method as claimed in claim 16, wherein the weft thread is supplied via a movable auxiliary main nozzle and a main nozzle, and further comprising the steps of, whenever the auxiliary main nozzle is moved, first presenting the auxiliary main nozzle to the main nozzle, such that the thread is inserted into the main nozzle by blowing of the auxiliary main nozzle and sucking of the main nozzle, and subsequently moving the auxiliary main nozzle back to a predetermined distance from the main nozzle.

* * * * *